United States Patent [19]

Kiritani et al.

[11] Patent Number: 4,579,815

[45] Date of Patent: Apr. 1, 1986

[54] PROCESS FOR PRODUCING PHOTOGRAPHIC SUPPORTS BY ELECTRON BEAM EXPOSURE

[75] Inventors: Masataka Kiritani; Yasuji Asao, both of Shizuoka, Japan

[73] Assignee: Fuji Photo Film Co., Ltd., Kanagawa, Japan

[21] Appl. No.: 647,585

[22] Filed: Sep. 5, 1984

[30] Foreign Application Priority Data

Sep. 5, 1983 [JP] Japan ..... 58-162938

[51] Int. Cl.[4] ..... G03C 1/86

[52] U.S. Cl. ..... 430/538; 430/531; 430/536; 427/35; 427/44

[58] Field of Search ..... 430/296, 271, 538, 531, 430/536; 427/35, 44; 162/136, 168.1, 192

[56] References Cited

U.S. PATENT DOCUMENTS 4,320,450 3/1982 Gray et al. ..... 427/44
4,332,836 6/1982 Urban ..... 427/44
4,364,971 12/1982 Sack et al. ..... 427/362
4,384,040 5/1983 Venmeer ..... 430/538

*Primary Examiner*—Jack P. Brammer
*Attorney, Agent, or Firm*—Sughrue, Mion, Zinn Macpeak & Seas

[57] ABSTRACT

A process for producing a photographic paper is described, comprising coating a composition containing an unsaturated organic compound capable of being polymerized by irradiation with electron beams and an inorganic white pigment on the surface of a web support, and, after hardening the coated layer by irradiation with electron beams, coating thereon a photographic emulsion, wherein the improvement comprises performing the irradiation with electron beams while pressing the web support on a roll having a curvature radius of from 25 cm to 250 cm with the coated layer with said layer in a convexly curled state, and coating the photosensitive emulsion on the convexly curled surface of the web support.

25 Claims, 1 Drawing Figure

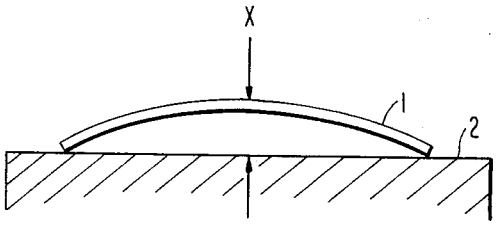
X
1
2

PROCESS FOR PRODUCING PHOTOGRAPHIC SUPPORTS BY ELECTRON BEAM EXPOSURE

FIELD OF THE INVENTION

This invention relates to a process for producing photographic paper. More particularly, the invention relates to a process for producing a photographic paper by coating photosensitive silver halide emulsions on a continuously travelling web support while controlling the occurrence of curling of the support.

BACKGROUND OF THE INVENTION

As a result of investigation for imparting a water resisting property to a support for photographic papers to provide for quick development of the photographic papers, a waterproof support for photographic papers composed of a paper coated with polyethylene on both surfaces thereof has been developed and widely used.

In a photographic paper prepared by coating on the surface of such a waterproof support silver halide emulsion layers, a severe curling (bending) phenomenon occurs with the silver halide emulsion layer at the inner side, and hence the fundamental solution to the foregoing problem as a problem peculiar to a waterproof paper has been desired. Therefore, the cause of the aforesaid curling phenomenon was investigated by analyzing the production steps of waterproof papers, and as the result thereof it was confirmed that when a photographic silver halide emulsion coated on the surface of a support is dried to form a silver halide emulsions layer in solid state, a shrinkage of volume occurs to cause a shrinking stress inside of the emulsion layer, whereby curling occurs with the emulsion layer at the inner side. If such curling occurs, the photographic paper thus finished cannot be properly maintained in a tabular state, and handling of the photographic paper becomes troublesome owing to the bending, thus greatly reducing the commercial value of the photographic paper.

As one method of solving such a curling problem, a method has been proposed for obtaining a photographic paper having no curling by previously curling the support with the surface of the side to be coated with silver halide emulsions at the outer side, and then coating the photographic silver halide emulsions thereon to balance the curling with the shrinking stress occuring during the drying step of the photographic paper. For example, in a polyethylene-coated paper prepared by casting polyethylene in a molten state onto the surfaces of a travelling paper base, the following methods are industrially practiced. First, there is a method of providing curling to the support with the surface of the side to be coated with silver halide emulsions on the outer side by making the thickness of the polyethylene layer at the back side of the support thicker than the thickness of the polyethylene layer on the side to be coated with silver halide emulsions by utilizing the shrinking property of polyethylene, as shown in U.K. Pat. No. 1,269,802. Second, there is a method of providing curling to the support with the surface of the side to be coated with silver halide emulsions on the outer side by making the density of the polyethylene layer on the back side of the support higher than the density of the polyethylene layer on the side to be coated with silver halide emulsions by utilizing the shrinking property caused by the density of polyethylene, as shown in Japanese Patent Publication No. 9963/73.

However, such methods have been found to have problems as progress has been made on reducing the thickness of coated resin layer. That is, since the main purpose of coating resin layers on both surfaces of a paper support for waterproofing photographic paper is to prevent the permeation of a processing solution or water into the paper of the support, there is no specific lower limit on the thickness of the coated layers, but from an economic viewpoint, the thickness of the coated resin layers should be as thin as possible without reducing the water resisting property. Thus, investigations and efforts have been directed to thickness reduction of the coated resin layers and the industrial practice of using thin resin layers has advanced. However, with the progress of thickness reduction of coated resin layers, it has become difficult to control curling by utilizing the shrinking property of polyethylene as described above, and thus it has become difficult to obtain a support for waterproof photographic paper having excellent curling property by the above-described methods when using layers of reduced thickness.

On the other hand, Japanese Patent Application (OPI) No. 130626/77 (the term "OPI" as used herein refers to a "published unexamined Japanese patent application") provides a method for producing a support for waterproof photographic paper having an improved curling property by drying paper at different drying speeds at each surface when making the paper, to make a paper having curling, and then by forming resin layers on the surfaces by coating.

However, by the foregoing method, the reproducibility, i.e., obtaining a certain extent of curling of a paper, is difficult to obtain: or, in other words, even if the conditions for drying both surfaces of the support are sufficiently controlled, the extent of curling of the paper may deviate, and hence the efficiency of the method is unsatisfactory from a practical viewpoint.

It has also known to impart water resisting property to a paper support by coating an organic compound having an unsaturated bond capable of being polymerized by the irradiation of electron beams on the paper support in place of polyolefin and hardening the coated organic compound by the irradiation of electron beams as disclosed in Japanese Patent Application (OPI) Nos. 27257/82 (corresponding to U.S. Pat. No. 4,384,040, hereinafter the same), 30830/82 (U.S. Pat. No. 4,364,971) and 49946/82 (U.S. patent application Ser. No. 300,526). However, a method of controlling curling by using an electron beam-hardenable unsaturated organic compound has not been known.

SUMMARY OF THE INVENTION

As a result of extensive investigations for overcoming the above-described difficulties and discovering an effective method for controlling curling of a web support even when coated resin layers are very thin or even when a resin having less shrinking property is used for forming resin layers, the inventors have succeeded in attaining this invention.

Curling of a web support may occur in a direction such that the axis of curling is perpendicular to the travelling direction of the support web and in a direction such that the axis of curling is in the travelling direction of the support web. The direction in which curling is more liable to occur and for which the extent of curling is large is the axis of curling perpendicular to the travelling direction of the support web. This is considered to be due to the influences of the orientation of pulp in the paper making process, and also the curling tendency of a support web in the paper making process, the step of coating the waterproof layers, and the step of coating the silver halide emulsion layers.

The present invention prevents the occurrence of curling having an axis perpendicular to the travelling direction of a support web.

In this invention, by using an electron beam-hardenable unsaturated organic compound as coated layers in place of polyethylene, curling is controlled together with hardening of the coated layers.

That is, the inventors have discovered a method of controlling the occurrence of curling based on a completely different idea from the conventional use of polyolefin.

In this invention, an electron beam-hardenable coated layer is formed on the side of a support to be coated with silver halide emulsion layers and after hardening the coated layer by the irradiation with electron beams on a roller under pressing with said coated layer side at the outside, a silver halide emulsion layer of emulsion layers are coated on the convexly curled side of the support.

The curvature of the roller onto which the support web is pressed while hardening the coated layer is very important in the present invention, and it is necessary that the curvature radius of the roller be in the range of from 25 cm to 250 cm. If the curvature radius is over 250 cm, the curling value (defined below) of the photographic paper after developing and fixing the photographic paper is over 0.1, giving undesirable results for practical use. Also, if the curvature radius is less than 25 cm, the curling value becomes less than −0.1, also giving undesirable results for practical use.

Thus, according to this invention, there is provided a process for producing a photographic paper comprising coating a composition containing an unsaturated organic compound capable of being polymerized by the irradiation with electron beams and an inorganic white pigment on the surface of a web support and after hardening the coated layer by irradiation with electron beams, coating thereon a photosensitive emulsion, wherein the improvement comprises performing the irradiation with electron beams while pressing the web support on a roller having a curvature radius of from 25 cm to 250 cm with the coated layer to be hardened at the outside to harden the coated layer with said layer in a convexly curled state, and coating the photosensitive emulsion on the convexly curled surface of the web surface.

BRIEF DESCRIPTION OF THE DRAWING

The FIGURE is schematic view showing the measurement of the value of curling of a photographic paper.

DESCRIPTION OF PREFERRED EMBODIMENTS

The definition of the curling value of the photographic paper of this invention is as follows. That is, a photographic paper for which a development is finished is cut into a rectangle of 10 cm in the travelling direction of the paper at coating and 2 cm in the width direction, and the cut piece is placed on a stand horizontally maintained in a chamber kept at a temperature of 23±1° C. and a relative humidity of 60±5% with the curled surface directing below as shown in the FIGURE. In the FIGURE, the value of curling is defined as the maximum distance X (cm) between the surface of the curled paper 1 and the surface of the stand 2 in the FIGURE. When the surface of the silver halide emulsion side is at the inner side, the curling value is defined as having a positive value, and when the surface of the silver halide emulsion layer is at the outer side, the curling value is defined as having a negative value for indicating the direction of curling.

If an ordinary curling value is in the range of from +0.1 cm to −0.1 cm, there are no practical problems in using the photographic paper.

The curvature radius of the roller used in the process of this invention is preferably from 30 cm to 200 cm, and more preferably from 40 cm to 150 cm.

Unsaturated organic compounds capable of being polymerized or hardened upon irradiation with electron beams, which can be used to produce the coated layer in the present invention, include essentially all polymerizable or hardenable compounds having at least one C=C double bond per molecule. Preferably, these compounds have at least two and more preferably three or four C=C double bonds per molecule, and have a molecular weight ranging from about 300 to 20,000. In order to obtain a coated layer having a surface with scratch resistance which is also flexible, it is advantageous to use mixtures of unsaturated resins or unsaturated prepolymers and unsaturated monomers such as vinyl monomers as the unsaturated organic compounds of the present invention so as to make possible a controlled cross-linking during polymerization. It is possible to use alone the above-described unsaturated resin, unsaturated prepolymer or unsaturated monomer. However, use of the unsaturated monomer alone results in the formation of coating which is too brittle.

Examples of commercially available unsaturated resins or prepolymers having at least two C=C double bonds in one molecule and capable of being hardened by the irradiation with electron beams include following:

acryl ester of an aliphatic polyurethane (molecular weight of 500 to 5,000);

acryl ester of a terephthalic acid diol (or polyol) polyester (molecular weight of 500 to 5,000);

acryl ester of a dihydric or polyhydric polyether alcohol (molecular weight of 500 to 5,000);

acryl ester of a methylolmelamine resin (molecular weight of 500 to 5,000);

maleic acid ester of polyester (molecular weight of 500 to 5,000);

acryl ester of bisphenol A-epoxy resin (molecular weight of 800 to 5,000);

unsaturated polyester resin (molecular weight of 500 to 5,000);

styrene/butadiene copolymer resin (molecular weight of 500 to 5,000);

acrylic acid ester of hydrolyzed starch or hydrolyzed cellulose (molecular weight of 500 to 5,000); and fumaric acid-diol polyester (molecular weight of 500 to 5,000).

These unsaturated resins or prepolymers are generally used in an amount of 1 to 30 g/m$^2$, preferably 5 to 15 g/m$^2$ and more preferably 7 to 12 g/m$^2$.

Examples of monomers which can be hardened by a high-speed electron beam include the following:

acrylic acid ester or methacrylic acid ester of a monohydric or dihydric alcohol having at least one —$CH_2$— group (e.g., hexadiol diacrylate, hydroxyethyl methacrylate, etc.);

acrylic acid ester of methacrylic acid ester of a monovalent or divalent alcohol having a $—(CH_2—CH_2—O)_n—$ group (wherein, n is 1 or more) (e.g., diglycol diacrylate, etc.);

mono-, di-, tri-, tetra- or penta-acrylate of a polyhydric alcohol (e.g., trimethylolpropane triacrylate, neopentyl glycol (meth)acrylate, pentaerythritol triacrylate, etc.);

cyanoethyl acrylate;

glycidyl (meth)acrylate;

allyl acrylate;

cyclohexyl methacrylate;

diallyl fumarate; and divinylbenzene.

These monomers are generally used in an amount of 0 to 18 g/m$^2$, preferably 1 to 6 g/m$^2$ and more preferably 2 to 4 g/m$^2$.

In principle, other vinyl compounds can also be used. However, many vinyl compounds are volatile and thus are not so practical.

In order to improve the scratch resistance and to control the hardness of the coated layer, an unhardenable resin having preferably a molecular weight of about 1,000 to 7,000 may be added to the layer. The amount of unhardenable resin is generally not more than 5 g/m$^2$, preferably not more than 2 g/m$^2$ and more preferably from 0.5 to 1 g/m$^2$. The following resins are examples of these types of resins.

Cellulose esters

Polyvinyl butyrals

Polyvinyl acetates and vinyl acetate copolymers

Unhardenable polyester resins

Styrene/acrylate resins

Polystyrene resins.

Examples of the inorganic white pigment which can be used in this invention include $TiO_2$, ZnO, $SiO_2$, $BaSO_4$, $CaSO_4$, $CaCO_3$, talc, clay, etc., but any other inorganic white pigment can be also used.

Also, $TiO_2$, etc., coated with organic compounds, or $TiO_2$, etc., coated with inorganic compounds for improving the dispersibility of the inorganic white pigments or preventing the inorganic white pigments from becoming yellow with the passage of time can be used in this invention.

The mean particle size of the white inorganic pigment which is used for the coating mixture in this invention is larger than 0.1 μm, and preferably larger than 0.15 μm. White inorganic pigments having a mean particle size of less than 0.1 μm do not provide a desired improvement of resolving power.

Pigments for giving blue, purple, and red color tones may be added to the coating mixture colored in white for matching each test of color for the subjective white impression of the layer. Furthermore, the addition of such a pigment must compensate the yellow color image line of the resin layer or an optional color image line of photosensitive silver halide emulsion layers in each case. In practice, inorganic color pigments such as ultramarine, cobalt blue, cobalt violet, cadmium red, etc., and organic color pigments such as phthalocyanine pigment, etc., are used.

For a specific purpose, a large amount of strongly coloring pigment may be incorporated in the coating mixture as, for example, a halation preventing agent. In particular, a resin-coated paper which is used for a silver salt-diffusion transfer coating process contains carbon black or fine graphite particles in the waterproof lacquer layer for the intended purpose. In this case, there is no particular lower limit on the particle size of the pigment.

The content of the white inorganic pigment is generally from 20 to 70% by weight based on the total weight of the hardenable coating composition.

For controlling the viscosity of the coating composition to improve the coating property of the composition, an organic solvent may be added to the coating composition. Examples of the organic solvent include ketones such as acetone, methyl ethyl ketone, methyl isobutyl ketone, cyclohexanone, etc.; esters such as methyl acetate, ethyl acetate, butyl acetate, ethyl lactate, glycol acetate monoethyl ether, etc.; glycol ethers such as ether, glycol dimethyl ether, glycol monoethyl ether, dioxane, etc.; tar series solvents (aromatic hydrocarbons) such as benzene, toluene, xylene, etc.; chlorinated hydrocarbons such as methylene chloride, ethylene chloride, carbon tetrachloride, chloroform, ethylenechlorohydrin, dichlorobenzene, etc.

A web support onto which the coating composition in this invention is coated is an optional photographic base paper containing a neutral size such as an alkylketone dimer, etc., or a size such as a resin soap, an aliphatic acid soap, an aliphatic acid anhydride, a carboxy-denatured polyvinyl alcohol, etc.

Furthermore, the base paper advantageously contains a pigment or an additive having an antistatic property.

The base paper may have a thickness of from 60 to 300 g/m$^2$, and preferably 80 to 200 g/m$^2$, and can be prepared from cellulose fibers or a mixture of cellulose fibers and synthetic fibers.

Also, by using a paper support coated with a polyolefin such as polyethylene, etc., on one or both surfaces of the support, a support for photographic paper having good surface properties and no pinholes can be obtained. It is desirable to incorporate a white pigment in the polyolefin layer coated on the side to be coated with silver halide emulsions since the resolving power and the whiteness of the resulting photographic paper are improved. A paper support may also have a back coating of an electron beam-hardened organic compound (i.e., on the opposite surface to the surface to be coated with a silver halide emulsion).

In addition, plastic sheets such as polypropylene, polystyrene, polyethylene terephthalate, etc. can be used as the web support in the present invention. These plastic web supports may contain a white pigment for the purpose of increasing whiteness and specific gravity of the supports. Further the plastic web support may have a back coating of polyolefins such as polyethylene, polypropylene, etc. or an electron beam-hardened organic compound. In the case, the back coating may also contain a white pigment where the whiteness of the back surface of support is desired or an opaque support is required.

The web support which can be used in the present invention generally has a thickness of about 60 to 300 μm and preferably about 80 to 200 μm.

For kneading of the composition which is used in this invention, various kinds of kneaders can be used. For example, a double roll mill, a triple roll mill, a ball mill, a pebble mill, throne mill, a sand grainder, a Azegvari attritor, a high-speed impeller, a high speed stone mill, a high speed impact mill, a dispersing machine, a kneader, a high speed mixer, a homogenizer, a ultrasonic dispersing machine, etc., can be used.

Techniques for kneading and dispersing which can be used in this invention, are described, e.g., in T. C. Patton, *Paint Flow and Pigment Dispersion,* (published by John Wiley & Sons Co., 1964), and also in U.S. Pat. Nos. 2,581,414 and 2,855,156.

The above-described coating composition can be coated on a travelling web support by, for example, an air doctor coating, blade coating, bar coating, air knife coating, squeeze coating, impregnation coating, reverse roll coating, transfer roll coating, gravure coating, kiss coating, cast coating, spray coating, spin coating, etc. Practical explanations of such coating methods are described, e.g., in *Coating Kogaku* (*Coating Engineering*), pages 253–277 (published, Mar. 20, 1971).

It is proper that the thickness of the layer of the above-described composition be from 3 to 100 μm, and preferably from 5 to 50 μm. If the thickness is outside the range, uneven coating forms and a large amount of energy is required for hardening, which results in making hardening insufficient.

Examples of electron beam accelerators which are used for polymerizing or hardening the composition layer by the irradiation thereby in this invention, there is a Van de Graaff-type scanning system, double scanning system, and curtain beam system; the curtain beam system, capable of a large output at a relative low cost, is preferred.

It is required that the absorption dose of the irradiation with electron beams be sufficient to completely harden the coated layer of the aforesaid composition, such that more than 80%, preferably more than 90%, more preferably more than 95%, of the unsaturated organic compounds are reacted.

The aforesaid reactivity is a percentage of the polymer component remaining without being extracted in the case of extracting the unpolymerized component in the coated layer of the composition with a solvent for the unsaturated organic compound.

For controlling the reactivity as described above, the absorption dose of electron beams is controlled. A proper absorption dose of electron beams is from about 1 to 10 M. Rad.

For preventing the hardening reaction from being disturbed by oxygen in the air during the irradiation of electron beams, air in the hardening reaction system is discharged by nitrogen gas.

In order to obtain a support having a desired surface form, such as smooth surface, silk surface, and mat surface, before or after the irradiation of electron beams, the surface of the support can be pressed onto a roller having a desired surface form to transfer the surface form of the roller onto the surface of the support.

The surface form of a roller can be desirably selected for matching the desired surface form of the support for photographic paper.

For obtaining a smooth surface of the support, a calender roller having a smooth mirror surface-finished surface is used. For obtaining a mat surface or a silk surface, an embossing roller having unevenness of 5 to 50 μm is used.

After treating the surface of the support by irradiation with electron beams, a surface treatment such as corona treatment, etc., or a subbing layer may be applied to the surface thereof for improving the adhesive property with respect to the silver halide emulsion layer. Furthermore, an antistatic agent, etc., may be added to the composition of this invention.

In this invention, it is necessary that the composition containing the unsaturated organic compound which can be polymerized by the irradiation with electron beams and an inorganic white pigment be coated on at least one surface of the web support. The composition may be coated on both surfaces of a web support, but the object of this invention can also be attained by coating the aforesaid composition on the surface of a support to be coated with a silver halide emulsion and the composition containing no inorganic white pigment on the opposite surface of the support.

The coating of the composition and hardening by irradiation with electron beams can be conducted for each surface individually (i.e., as separate operations) but it is industrially desirable that after coating the compositions on both surfaces of a support, the support is pressed on a roller with the surface of the support which is to be coated with a silver halide emulsion on the outside and the coated layers on both surfaces of the support are hardened by the irradiation with electron beam. In the case of hardening, in succession, the coated layers separately, it is desirable to perform the hardening of the coated layer on the surface opposite to the surface which is to be coated with a silver halide emulsion on a flat surface or while pressing the web support on a roller having a larger curvature radius than that of a roller which is used for hardening the surface of the support to be coated with a silver halide emulsion.

The invention is explained in further detail based on the following examples, in which all parts are by weight unless otherwise indicated.

EXAMPLE 1

| | |
|---|---|
| Coating Composition A: | |
| Titanium Oxide | 50 parts |
| Urethane Series Acrylate Oligomer (used in Example 1 of U.S. Pat. No. 4,092,173) | 40 parts |
| Diethylene Glycol Diacrylate | 30 parts |
| Acetone | 200 parts |
| Coating Composition B: | |
| Urethane Series Acrylate Oligomer (used in Example 1 in U.S. Pat. No. 4,092,173) | 40 parts |
| Diethylene Glycol Diacrylate | 30 parts |
| Acetone | 200 parts |

Web Support C:

A surface size was applied to the surface of a base paper of 155 g/m$^2$ with carboxy-modified polyvinyl alcohol and then the support was subjected to a calender treatment to provide a surface of 150 sec. in BEC smoothness.

The coating composition B was coated on the surface of the travelling web support C at a dry thickness of 15 μm by bar coating, and, after removing the solvent, the coated layer of the support was irradiated with electron beams at an absorption dosage of 3M Rad while maintaining the web support at a flat state.

Furthermore, the coating composition A, stirred for 20 hours by means of a ball mill, was coated on the opposite surface of said web support to the surface coated with the coating composition B, at a dry thickness of 20 μm by bar coating, and after removing the solvent by passing the web support through a drying zone, the coated layer was irradiated with electron beams at an absorption dosage of 3M Rad while pressing the web support on a metal roller having a curvature radius of 80 cm, with the coated layer of the coating composition A at the outside.

The surface of the waterproof support having the layer of the coating composition A thus obtained was activated by a corona discharging treatment and a silver halide emulsion for photographic paper composed of gelatin, silver bromide, and silver iodide was coated on the surface. After allowing the coated support to stand in a chamber maintained at 4° C. for 2 minutes, the coated support was placed in chambers maintained at 10° C., 25° C. and 35° C. for 1 minute, 4 minutes, and 2 minutes, respectively, to completely dry the silver halide emulsion layer. The thickness of the silver halide emulsion layer after drying was 9 μm.

When after negative-exposing the photographic paper thus prepared, the photographic paper was developed and dried by a hot blast of 80° C., and then the curling measurement was performed, curling value was 0.0 cm.

EXAMPLE 2

The coating compositions A and B as in Example 1 were coated on both surfaces of the web support C at dry thicknesses of 20 μm and 15 μm, respectively, by bar coating and both the surfaces were irradiated by electron beams at an absorption dosage of 5M Rad to simultaneously harden both the coated layers while pressing the support on a metal roller having a curvature radius of 120 cm with the surface coated with the coating composition A at the outside. Thereafter, the web support was treated as in Example 1 to provide a photographic paper.

The curling value of the photographic paper after development and drying was 0.0 cm.

COMPARISON EXAMPLE 1

A photographic paper was prepared by following the same procedure as in Example 1 except that hardening of the coating composition A layer was performed in a flat state without pressing the web support on the metal roll having a curvature radius of 80 cm. When the photographic paper was dried after development and curling was measured, the curling value was plus 0.3 cm.

COMPARISON EXAMPLE 2

A photographic paper was prepared by following the same procedure as in Example 1 except that hardening of the waterproof layer at the side of the support to be coated with a silver halide emulsion was performed using a metal roller having a curvature radius of 300 cm in place of the metal roller having a curvature radius of 80 cm.

When the photographic paper was dried after development and curling was measured, the curling value was plus 0.2 cm.

COMPARISON EXAMPLE 3

A photographic paper was prepared by following the same procedure as in Example 1 except that hardening of the waterproof layer of the support to be coated with a silver halide emulsion layer was performed using a metal roller having a curvature radius of 10 cm in place of the metal roller having a curvature of 80 cm. When the photographic paper is dried after development and curling was measured, the curling value was minus 0.2 cm.

While the invention has been described in detail and with reference to specific embodiments thereof, it will be apparent to one skilled in the art that various changes and modifications can be made therein without departing from the spirit and scope thereof.

What is claimed is:

1. A process for producing a photographic sheet comprising coating a composition containing an unsaturated organic compound capable of being polymerized and hardened by irradiation with electron beams and an inorganic white pigment on the surface of a web support, and, after hardening the coated layer by irradiation with electron beams, coating thereon a photosensitive emulsion, wherein the improvement comprises performing the irradiation with electron beams while pressing the web support on a roller having a curvature radius of from 25 cm to 250 cm with the coated layer to be hardened at the outside, to harden the coated layer with said layer in a convexly curled state, and coating the photosensitive emulsion on the convexly curled surface of the web support.

2. A process for producing a photographic sheet as in claim 1, wherein the web support is paper.

3. A process for producing a photographic sheet as in claim 1, wherein the web support is paper coated with a polyolefin on both surfaces thereof.

4. A process for producing a photographic sheet as in claim 1, wherein the web support is paper coated with a polyolefin on the opposite surface to the surface to be coated with the photosensitive emulsion.

5. A process for producing a photographic sheet as in claim 1, wherein the web support is paper having a layer of hardened unsaturated organic compound on the opposite surface to the surface to be coated with the photosensitive emulsion.

6. A process for producing a photographic sheet as in claim 1, wherein the web support is a plastic sheet.

7. A process for producing a photographic sheet as in claim 1, which further comprises coating a composition containing an unsaturated organic compound capable of being polymerized by irradiation with electron beams on the surface of the web support opposite to the surface coated with the composition of claim 1, and simultaneously hardening the both coated layers by irradiation with electron beams.

8. A process for producing a photographic sheet as in claim 1, wherein the curvature radius of the roller is from 30 cm to 200 cm.

9. A process for producing a photographic sheet as in claim 2, wherein the curvature radius of the roller is from 30 cm to 200 cm.

10. A process for producing a photographic sheet as in claim 3, wherein the curvature radius of the roller is from 30 cm to 200 cm.

11. A process for producing a photographic sheet as in claim 4, wherein the curvature radius of the roller is from 30 cm to 200 cm.

12. A process for producing a photographic sheet as in claim 5, wherein the curvature radius of the roller is from 30 to 200 cm.

13. A process for producing a photographic sheet as in claim 6, wherein the curvature radius of the roller is from 30 cm to 200 cm.

14. A process for producing a photographic sheet as in claim 7, wherein the curvature radius of the roller is from 30 cm to 200 cm.

15. A process for producing a photographic sheet as in claim 1, wherein the curvature radius of the roller is from 40 cm to 150 cm.

16. A process for producing a photographic sheet as in claim 2, wherein the curvature radius of the roller is from 40 cm to 150 cm.

17. A process for producing a photographic sheet as in claim 3, wherein the curvature radius of the roller is from 40 cm to 150 cm.

18. A process for producing a photographic sheet as in claim 4, wherein the curvature radius of the roller is from 40 cm to 150 cm.

19. A process for producing a photographic sheet as in claim 5, wherein the curvature radius of the roller is from 40 cm to 150 cm.

20. A process for producing a photographic sheet as in claim 6, wherein the curvature radius of the roller is from 40 cm to 150 cm.

21. A process for producing a photographic sheet as in claim 7, wherein the curvature radius of the roller is from 40 cm to 150 cm.

22. A process for producing a photographic sheet as claimed in claim 1, wherein said unsaturated organic compound is a compound containing two or more C=C double bonds per molecule and has a molecular weight ranging from about 300 to 20,000.

23. A process for producing a photographic sheet as claimed in claim 1, when said unsaturated organic compound is selected from the group consisting of an acryl ester of an aliphatic polyurethane having a molecular weight of 500 to 5,000; an acryl ester of a terephthalic acid diol or polyol polyester having a molecular weight of 500 to 5,000; an acryl ester of a dihydric or polyhydric polyether alcohol having a molecular weight of 500 to 5,000; an acryl ester of a methylolmelamine resin having a molecular weight of 500 to 5,000; a maleic acid ester of polyester having a molecular weight of 500 to 5,000; an acryl ester of bisphenol A-epoxy resin having a molecular weight of 800 to 5,000; an unsaturated polyester resin having a molecular weight of 500 to 5,000; a styrene/butadiene copolymer resin having a molecular weight of 500 to 5,000; an acrylic acid ester of hydrolyzed starch or hydrolyzed cellulose having a molecular weight of 500 to 5,000; and a fumaric acid-diol polyester having a molecular weight of 500 to 5,000.

24. A process for producing a photographic sheet as claimed in claim 23, wherein said unsaturated organic compound is used in an amount of 1 to 30 $g/m^2$.

25. A process as claimed in claim 1, wherein said inorganic white pigment is selected from the group consisting of $TiO_z$, ZnO, $SiO_2$, $BaSO_4$, $CaSO_4$, $CaCO_3$, talc and clay.

* * * * *